US005984484A

United States Patent [19]

Kruer

[11] Patent Number: 5,984,484

[45] Date of Patent: Nov. 16, 1999

[54] LARGE AREA PULSED SOLAR SIMULATOR

[75] Inventor: Mark A. Kruer, Redondo Beach, Calif.

[73] Assignee: TRW Inc., Redondo Beach, Calif.

[21] Appl. No.: 08/961,721

[22] Filed: Oct. 31, 1997

[51] Int. Cl.[6] ..... F21V 7/00

[52] U.S. Cl. ..... 362/1; 362/351; 362/263; 362/346

[58] Field of Search ..... 362/1, 157, 217, 362/322, 263, 282, 283, 351, 346; 359/838, 839

[56] References Cited

U.S. PATENT DOCUMENTS 3,247,367 4/1966 Rayces ..... 362/1
4,570,209 2/1986 Wittlin ..... 362/2

*Primary Examiner*—Sandra O'Shea
*Assistant Examiner*—Marshall Honeyman
*Attorney, Agent, or Firm*—Michael S. Yatsko; Ronald M. Goldman

[57] ABSTRACT

An advanced solar simulator illuminates the surface a very large solar array, such as one twenty feet by twenty feet in area, from a distance of about twenty-six feet with an essentially uniform intensity field of pulsed light of an intensity of one AMO, enabling the solar array to be efficiently tested with light that emulates the sun. Light modifiers sculpt a portion of the light generated by an electrically powered high power Xenon lamp and together with direct light from the lamp provide uniform intensity illumination throughout the solar array, compensating for the "square law" and "cosine law" reduction in direct light intensity, particularly at the corner locations of the array. At any location within the array the sum of the direct light and reflected light is essentially constant.

24 Claims, 7 Drawing Sheets

LARGE AREA PULSED SOLAR SIMULATOR

STATEMENT OF GOVERNMENT SUPPORT

This invention was conceived during the course of Contract or Subcontract No. GGMS31100 under NAS5-32500 for NASA. The government has certain rights in this invention.

FIELD OF THE INVENTION

This invention relates to large area pulsed solar simulators and, more particularly, to an improvement that increases the area over which the solar simulator produces an essentially uniform intensity of light.

BACKGROUND

Spacecraft employ solar arrays to convert solar energy to the DC current needed to provide the necessary electrical power on-board the spacecraft. Consisting of large numbers of photovoltaic generators arranged in the rows and columns of a matrix on panels joined together into an essentially planar array that covers a wide two-dimensional area, the solar array is oriented toward the sun and converts the incident light into electricity. To ensure that the individual photo-voltaic generators within the array are functional, it is conventional to test the array and measure the performance of the photo-voltaic generators prior to deployment in spacecraft. Any defective photo-voltaic generators found are conveniently replaced. A solar simulator is used for that test.

The solar simulator provides a pulse of light to the array that emulates light from the sun. Ideally, the solar simulator should provide an equal amount of light over the entire surface of the array, that is, uniform illumination. A standard large area pulsed solar simulator ("LAPSS") contains an electronically controlled electrical load that "dumps" a tailored current/voltage pulse, a pulse of defined width, height and waveshape, as may be viewed on an oscilloscope, into an Xenon lamp, which produces a burst of light or, as variously termed, a light pulse. Typically, the Xenon lamp is housed within a metal box and the light generated is emitted through an outlet aperture or light window, as variously termed, formed in the metal box.

The light pulse is essentially uncontrolled in terms of the light wave characteristic, except as governed by basic principles of physics. At a fixed distance from the test plane containing the solar array, the simulator's light pulse is typically designed to be equal to the intensity of the "solar constant" at the average earth distance from the sun, referred to as AMO, a value expressed in units of watts per square meter. Presently available solar simulators are found to deliver light with an acceptable plus or minus two per cent uniformity, regarded as "uniform" in this field, only over a relatively small area, as limited by the power pulse from the LAPSS's lamp bulb and the distance of the light bulb to the test plane.

A typical 2.5 kilowatt Xenon bulb found in the prior designs for the LAPSS's provides a "one sun" AMO equivalent of the requisite uniformity over a maximum area of eight feet by eight feet square, sixty-four square feet, at a distance to the test plane of twenty-five to twenty-eight feet, typically twenty-six feet. LAPSS's are known which achieve uniformity over an area of 10 feet by 10 feet, but require very high energy light pulses. Still another uses a folding parabolic mirror to achieve uniformity in luminance over a six foot by six foot area where the distance of the light source from the test plane is less critical than that required for large solar arrays.

To provide greater amounts of electricity on board the space craft, solar arrays, referred to as very large solar arrays, are being proposed that are greater in size and cover a larger area. In order to test very large solar arrays, a solar simulator must be capable of providing light of the requisite uniform intensity over an area of up to 400 square feet, that is over a square area of twenty feet by twenty feet in dimension. For reasons not relevant to the present invention, it is desired to accomplish that goal without increasing the distance to the test plane and without increasing the power of the Xenon lamp.

Accordingly an object of the present invention is to provide a new source capable of providing uniform illumination over a large area.

Another object is to expand the coverage area of an existing large area pulsed solar simulator and provide a new solar simulator that provides a relatively uniform plane of light over an area of 400 square feet on a test plane twenty-six distant.

An additional object of the invention is to provide a solar simulator capable of producing a uniform 1 AMO intensity field over a greater area than previously attainable, doing so without an increase in the lamp's size or wattage from that used in a prior simulator and at the same distance between the solar array and the simulator as before.

A still further object of the invention is to provide an improved solar simulator of increased coverage that is simple in structure and relatively easy to fabricate, adjust, and test.

And an ancillary object is to provide an illumination source capable of providing a uniform field of light over large planar surfaces and over curved surfaces as well.

SUMMARY OF THE INVENTION

The simulator of the present invention achieves coverage of a test plane, the plane at which the solar array is positioned for test, at the twenty six feet distance with one AMO light of uniform intensity over a greater area on the test plane than was heretofore possible and advances the state of the art in testing and qualification of large size solar arrays.

The advanced solar simulator permits coverage of a very large solar array, such as one that is twenty feet square, with an essentially uniform intensity field of pulsed light at an intensity of one AMO, at a distance of about twenty-six feet, enabling the solar array to be efficiently tested with light that emulates the sun. In this simulator an electrically powered 2.5 Kilowatt Xenon lamp serves as a source of direct light and light modifiers reflect incident light from the lamp to the remote corners of the solar array to compensate for the "square law" and "cosine law" reduction in direct light intensity at the corner locations of the array. In total, the sum of the direct light and reflected light at any location within the array is essentially constant and is one AMO in intensity. The advancement is accomplished without increasing the lamp power as used in existing simulators and without increasing the simulator to array distance from the desired twenty three to twenty nine foot spacing.

In accordance with the foregoing objects, a new LAPSS is characterized by a series of light modifiers housed in the same housing with the high intensity light source, suitably a Xenon lamp. The principal modifiers are mirrors, graduated in reflectivity, which reflect incident light from the lamp to the outer periphery of the test plane, where the direct light from the lamp is reduced. At the outer edges of the solar array reflected light from the mirror adds to the reduced level of direct light from the light source to increase the light at that location to the desired 1 AMO level. A secondary light modifier obstructs a direct path from the longitudinal center of the lamp to the test plane, when the lamp's maximum intensity is found to be greater than the desired 1 AMO, reducing the intensity at the center of the test plane to the desired level. The reflected and direct light intensities vary with location on the solar array, but integrate or combine to the desired intensity level, whereby a uniform field of light blankets the entire surface of the solar array, exposing each solar cell to essentially the same light intensity.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
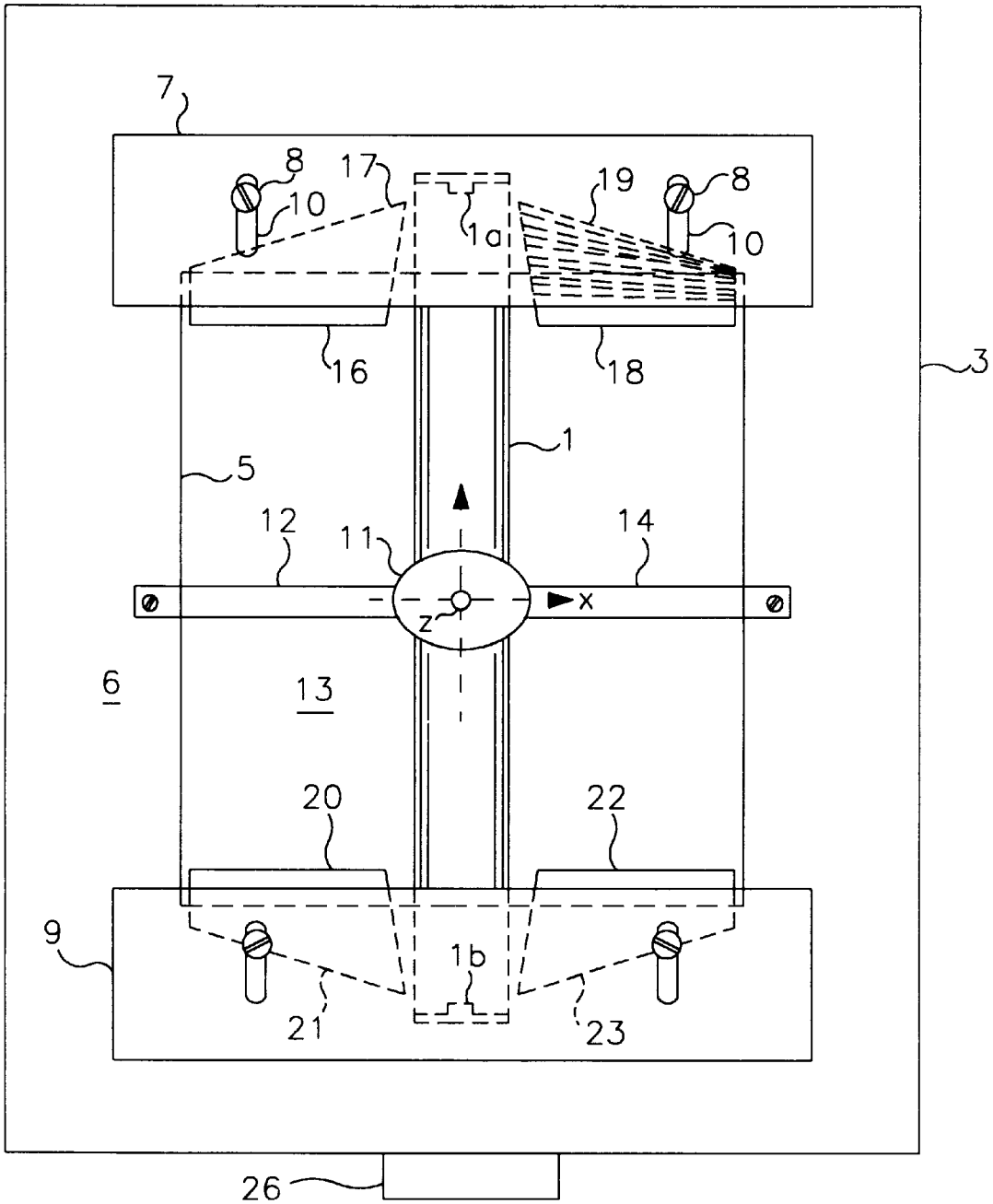
FIG. 1 illustrates an embodiment the invention as viewed from the front.

Reference is made to FIG. 1, which partially illustrates an embodiment of the solar simulator in front view. The solar simulator includes a source of high intensity light, preferably an Xenon lamp 1. Xenon lamp 1 is housed within a closed container or housing 3 and is visible through a square shaped aperture or light window 5 formed in front wall 6 of the container and between the upper and lower adjustment plates 7 and 9. The lamp is positioned spaced from the rear wall 13 and is located a short distance behind front wall 6. It is symmetrically positioned in light window 5, as illustrated, with its cylindrical axis vertical, in parallel with the vertical sides of the window and bisecting the window. Conventional lamp sockets, not illustrated, supported in the housing, support the lamp in the described position and provide the connection to the source of DC power, also not illustrated in the figure.

The Xenon lamp is a well known high intensity gas discharge type lamp and is available in many sizes. The lamp is formed with xenon gas confined in an elongated cylindrical glass envelope or, as variously termed, tube with the Xenon gas confined under pressure. Electrodes, 1*a* and 1*b*, are located at opposite ends of the glass tube. A source of DC voltage applied across the electrodes ionizes the gas, creating a gas discharge that conducts current and in turn releases energy in the form of heat and light.

In a practical embodiment of the present invention, the lamp is industrial sized, 2.5 Kilowatt in power, which is the same as used in the prior simulator designs. That high intensity gas discharge tube generates sufficient light to emulate the light from the sun at various distances from the lamp, such as the twenty three to twenty eight foot distances, and specifically the twenty six foot distance presently contemplated for a practical embodiment.

The aperture or window 5 in the housing's front wall is initially of a rectangular shape, as represented by the hidden lines behind adjustment plates 7 and 9, and is further defined by the straight horizontal edges of the adjustment plates that overlap the top and bottom edges of that cut-out to form a square shape, corresponding to the shape of the test plane. The plates are secured to the front wall by conventional bolt 8 and slot 10 arrangements and may be adjusted vertically in position to change the position of the top and bottom straight edges of the light window 5. In a practical embodiment, light window 5 is approximately eight inch by eight inch square.

The adjustment plates provide one means to fine tune calibration in conjunction with the adjustment of the mirror assemblies 17, 19, 21 and 23, and the light blocking or obscuring disk 11, which are described hereafter. The plate adjustment permits one to ensure that the light intensity may be base-lined at one AMO solar intensity at the test plane distance, twenty-six feet distant in the present practical embodiment. In other embodiments the proper sized opening for a fixed test plane distance may be cut directly into the housing's front wall and the adjustment plates would then be eliminated.

The inner walls of housing 3, including top, bottom, side, rear and front walls, are non-reflective to light. In a specific embodiment the container is formed of aluminum and at least the inner aluminum wall's surfaces are anodized, rendering the metal surfaces black in color and, hence, non-reflective.

To remove intense heat generated during operation and prolong the life of lamp 1, a electrically powered fan 26 is included to blow ambient air up through the housing, and out through the air exhaust openings, not illustrated, formed in the top wall of housing 3.

Figure 2:
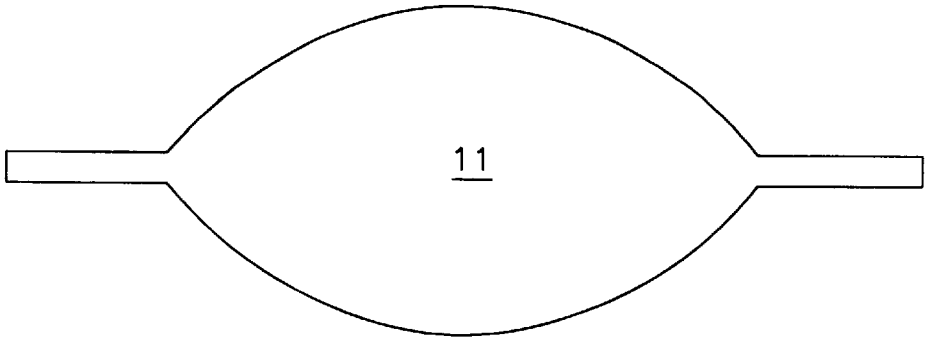
FIG. 2 is a front view of an obscuration plate used in the embodiment of FIG. 1 shown in greater scale.

A metal disk 11, referred to as a light attenuator or obscuring plate is mounted in the center of light window 5 and obscures a small portion of the light window 5. In this embodiment, the obscuring plate is a flat plate having the curved geometry resembling of a pair of saucers, one inverted over the other, the design of which is later herein more fully described. The obscuring plate is attached to the front wall 6 by narrow supporting brackets 12 and 14, bolted to the front wall. The opposite side of the plate and its support are anodized so as to be non-reflective. Obscuring disk 11 blocks a portion of the light originating from a portion of the lamp from direct incidence on the test plane, thereby modifying the light emitted by the lamp. A more accurate representation of the shape of obscuration plate 11 is presented in a larger scale in FIG. 2.

Returning to FIG. 1, four separate mirrors 17, 19, 21, and 23, arranged in two pairs, are located within the container behind the light window adjacent each end of lamp 1. Each of those mirrors is graduated in reflectivity characteristic, as later more fully described, whereby one position may reflect a greater amount of light than another portion. The mirrors are well known light reflectors and serve to modify the light projected upon a body such as a test plane surface, as later herein described more fully. In this embodiment the mirrors are formed on top of flat support plates 16, 18, 20 and 22, respectively. Those support plates are partially visible through the light window.

Mirrors 17 and 19 are mounted within the container alongside the lamp at the lamp's upper end, one to the left and the other to the right in the figure. They are recessed above the upper edge of light window 5. Not being visible through the window when viewed from the front of the assembly at the center of the test plane, the two mirrors are represented in dash lines. The other pair of mirrors 21 and 23 are mounted within the container alongside the lamp at the lamp's lower end, as before, one mounted to the left and the other to the right and these mirrors are recessed below the lower edge of light window 5. Also not visible through the window, the latter two mirrors are also represented in the figure by dash lines.

Figure 3:
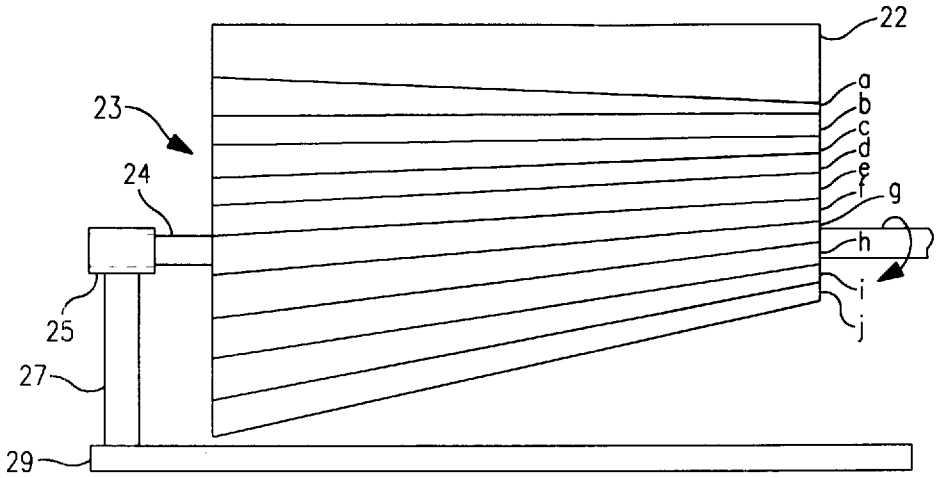
FIG. 3 illustrates an enlarged not-to-scale view of the mirror construction of the mirrors used in the embodiment of FIG. 1 and the mirror support.
Figure 4:
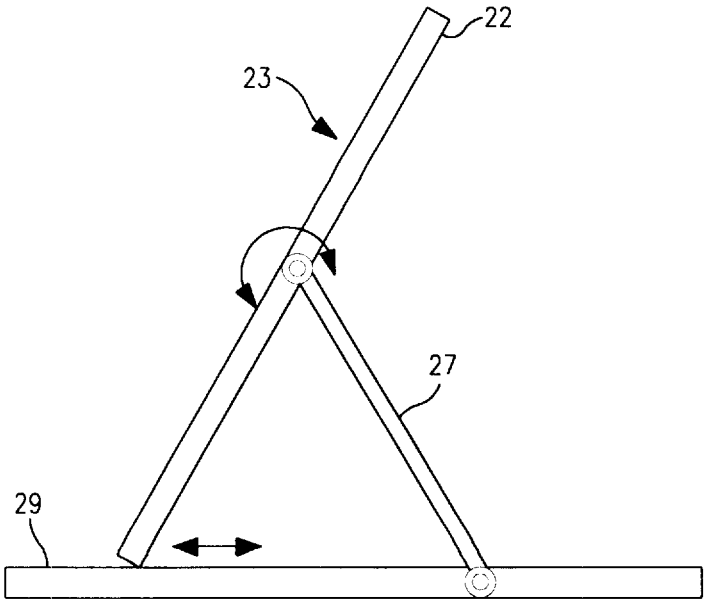
FIG. 4 illustrates another view of FIG. 3.

The mirror support plates, 16, 18, 20 and 22, and, hence the associated mirrors, 17, 19, 21 and 23, are supported in the housing by adjustable mounting brackets which allow for the associated mirror's angular adjustment relative to the X-Y plane or the plane of light window 5, and adjusting the mirror's tilt, the axes being represented by the Cartesian axes in FIG. 1 at the center of the assembly in which the Z axis is directed outward orthogonal to the plane of the paper. An exemplary one of the adjustable mounting brackets is illustrated in FIGS. 3 and 4, to which reference is made.

The adjustable support for the mirror assembly is quite simple and any form of adjustable support may be used. As illustrated, support plate 22, containing the mirror surfaces that define mirror 23 is by a pivotally mounted shaft 24, that is supported in a pivot 25. The pivot is supported upon an arm 27 that is also pivotally fastened to the pedestal 29. As shown in FIG. 4 the angular orientation of the mirror is easily changed. In turn the pedestal 29 is mounted by bolts within housing 3 and the orientation of the pedestal may be changed by loosening the bolts, changing the pedestal's orientation and re-tightening the bolts. Similar adjustable supports are provided for each of the remaining three mirrors.

Figure 5:
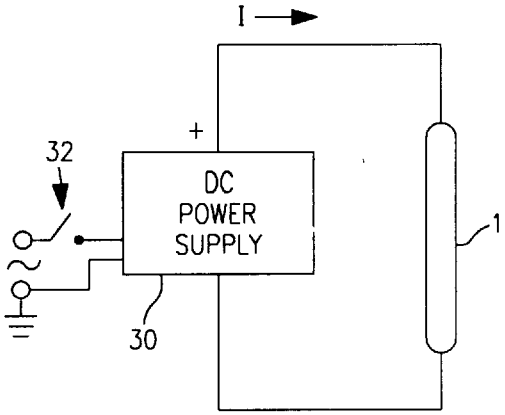
FIG. 5 is a schematic of a lamp power circuit used in connection with the embodiment of FIG. 1.

For operation Xenon lamp 1 is connected to a conventional DC electrical power supply and control circuit, as generally schematically illustrated in FIG. 5, with the DC power supply 30, on-off switch 32 and lamp 1 in series circuit. For solar simulation in typical application, the 2.5 kilowatt lamp requires about three million watts peak electrical power, and the power supply is accordingly physically large in size to handle the requisite current.

Returning to FIG. 1, for purposes of illustration, a series of dash lines within the surface of mirror 19 is used to graphically indicate that the mirror is formed of a number of elongate strips or segments having different light reflectivity characteristics located side by side. Also that those mirror segments appear to extend essentially horizontally in the view and are generally trapezoidal in shape and are substantially identical in size. The same feature is present in mirrors 17, 21 and 23, although that is not specifically illustrated in the figure.

Each of those mirrors is graduated in reflectivity so that the outermost segment or slice, as variously termed, of the mirror, that slice most distant from the exposed end of its associated support plate, possesses the greatest reflectivity, while succeeding slices have a progressively lesser reflectivity, as more fully explained hereinafter. In the practical embodiment the reflectivity characteristics range from a low of 0.04 which is that of plain glass to a high of 0.96 which is that of a high performance mirror.

An enlarged not-to-scale front view of one of the graduated reflectance mirrors, mirror 23, and its support plate 22 is illustrated in FIG. 3 to which reference is again made, the remaining mirror assemblies are of the same construction. The mirror is formed of a number of flat thin very thin webs whose surface provides a certain reflectivity. Thus in one construction a patch of material of a first reflectivity is glued to the surface of plate 22 using thermally conductive adhesive. Over that layer, a second shorter patch of another material of a higher reflectivity is glued over the first layer, leaving a trapezoidal shaped slice "a" of the first layer visible, as illustrated in larger scale in FIG. 6, which is only briefly noted. Then a still shorter patch of a third material of a still higher reflectivity is glued over the second layer, leaving another like-sized trapezoidal shaped slice "b" of the second layer visible.

The foregoing fabrication procedure is continued with shorter and shorter patches of material having higher and higher reflectivity. Upon completion, the mirror contains trapezoidal shaped slices "a" through "j", with slice "j" having the highest reflectivity and slice "a" the lowest, thereby providing a mirror whose reflectivity is graduated, that is, whose reflectivity varies with position along the mirror surface. Even though built up of very thin straight flat layers on a plate, the mirrors are still regarded overall as being essentially planar or flat.

Slices "a" through "j" may be of equal size, as in the preferred illustrated embodiment, or they may be unequal in size, with higher variable reflectance from layer to layer, as required to fill in the test plane with the desired light intensity. As noted the highest reflectivity slice of each mirror is oriented as earlier shown in FIG. 1 as being the slice most distant from the center of the light window 5, slice "j" in mirror 23 as example, so that the mirror reflects greater amount of incident light to the outermost corner of the test plane, where the square law loss of the direct light from lamp 1 is greatest.

As shown in FIG. 1, the mirrors are mounted so that they are not visible through the opening from a vantage point perpendicular to the center of the face of the light aperture 5. Only a portion of the non-reflective mirror support plate of each mirror assembly is visible at most. However the mirrors are visible from vantage points moving toward and along the edges of the test plane, from the center along the X-axis in FIG. 1 toward an edge of the test plane, as example, assuming the test plane as being of the same dimension of the large size solar panel to be tested. Hence, any light reflected from the mirrors is not directed toward the center of the test plane, but to its edges and, hence, on those edges of the solar panel placed under test at that plane.

The amount of light reflected to any particular location on the test plane is governed not only by the reflectivity of the slice of mirror surface, but also by the number of mirror slices that are able to be viewed from that location and the reflected image of lamp 1 in those mirror slices.

Figure 7:
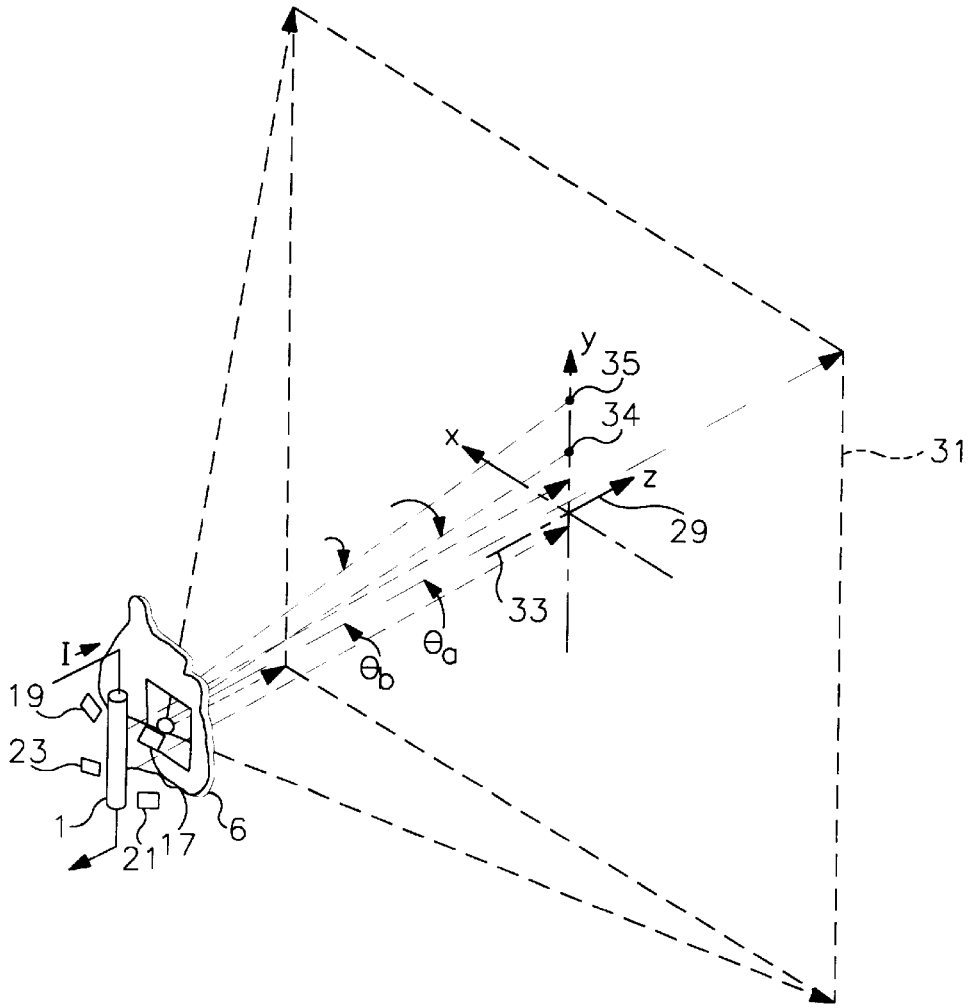
FIG. 7 pictorially illustrates the positioning of the elements of FIG. 1 to the test plane.
Figure 8:
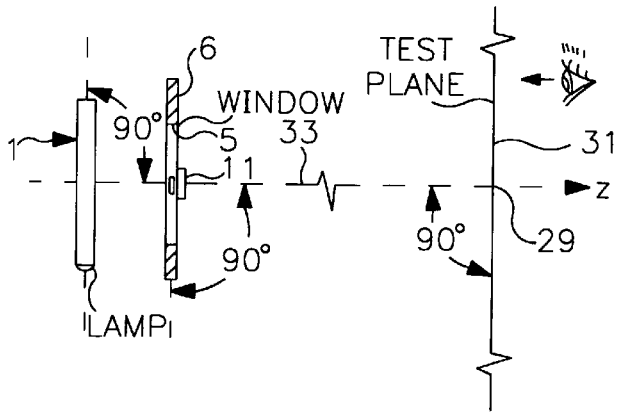
FIG. 8 pictorially illustrates the application of the embodiment of FIG. 1 and the relationship to the test plane in a side view.

Reference is made to the not-to-scale pictorial views of FIGS. 7 and 8. For purposes of explanation and to assist in understanding of the operation, the invention is described in connection with a test plane, generally represented by dash lines 31, that is located spaced from the front of the aperture, centered at the axis of the light aperture and parallel thereto. The test plane is an imaginary location and is the plane in which the planar solar panel is centered and located for test. A set of X, Y and Z Cartesian axes are centered at 29 in the test plane and, for purposes of these discussions, those axes are viewed from the rear side of the test plane. Hence, when reference is made in these discussions to moving to the right along the X-axis, as when looking back to light window 5, it should be understood that one is moving to the left along that axis in the view of FIG. 7, which views the test plane from its front side.

As shown in FIG. 8, lamp 1 and window 5, formed in wall 6, are centered on the Z-axis 33 and test plane 31 is also centered on that axis, and the axes of the cited elements 1 and 5 are perpendicular to that axis 33 and are oriented parallel to one another. As illustrated by FIG. 7 direct light from lamp 1, not blocked by obscuring plate 11 is incident on the test plane. That greatest intensity of direct light falls about the center 29 on the test plane.

For purposes of illustration only a few rays of light from the lamp are drawn that pass to the center area of the test plane. Likewise a ray of reflected light is shown propagating from lower positioned mirror 21 to the upper left corner of the test plane; another ray of light is shown propagating from the other mirror of that pair, mirror 23, to the upper right corner of the test plane. Another ray from upper mirror 17 is directed through the window to the lower left corner of the test plane as viewed in this figure, and still another from mirror 19 is directed to the lower right corner as viewed in this figure.

Mirrors 17, 19, 21 and 23, located within the housing, reflect the light from the lamp envelope to the test plane. The placement of the mirrors is adjusted so that at the center 29 of the test plane, the mirrors are not visible to the eye. As one moves along the test plane from center 29, along axis 34, to an edge of the plane, more of the mirrors surface becomes visible from that edge position. Since the mirror's surface reflects light from the lamp, more light is delivered to that edge position from off the mirrors. The mirror graduated reflectance characteristic is tailored to exactly or acceptably increase as a function of the distance along the test plane from the center.

According to well known physical principles, light intensity falls off as a function of the inverse of the square of the distance to the light source, the inverse square law, given by the equation $E=(I/r^2)\cos(\theta)$. Because the distance from the lamp face to the off-axis edge position on the test plane is greater than the distance of that light source to the center of the test plane, the light intensity emitted from the visible portion of the lamp is consequently reduced at the edge of the test plane.

Another known physical principal is that light from different sources incident at the same location is additive. The additional light reflected by the mirrors to that position adds to the remaining direct light and compensates for the foregoing reduction. Further, an additional reduction in intensity occurs due to "cosine law" losses from the increasing angular offset from the light source to the test plane, which is perpendicular only at the center of the plane. The light reflected by the mirror to that location compensates for that loss as well.

The mirror reflectance characteristic is not constant as in normal household mirrors, but is a variable. It is a graduated mirror. The reflectance characteristic of any particular portion of the mirror varies in dependence upon the particular geographic location of that portion on the mirror's surface. More precisely, by design the mirror is tailored to exactly as possible increase its reflectance characteristic as a function of the distance along the test plane from the center to the outer edge sufficient to compensate for the drop-off in direct light from the source by adding reflected light to thereby maintain a substantially constant intensity (luminance) over the test plane.

Mirror reflectance may be increased in any number of known ways. A glass mirror may be silvered with greater and greater amounts of silver covering the surface, whereby the reflectance of the mirror may be adjusted to between the reflectance of plain glass to the reflectance of a good second surface reflector. Also materials of known spectral reflectance, "brighteners", with respect to the spectrum of the LAPSS and the response of the solar cells may be incorporated onto a mirror mount in an increasingly (with distance) reflective pattern.

Another requirement is that the mirrors reflectance is maintained as a constant for any position when moving in the test plane perpendicularly to axis 33, the Z-axis, above and in the direction of the X-axis. In other words the reflected image of the lamp bulb remains a constant. This is accomplished by adjusting the angular attitude of the mirrors along axis 33 and axis 34 with reference to mounting of the Xenon lamp's envelope and by incorporating the correct trapezoidal slope or taper in the mirror elements "a" through "j", represented in FIG. 3.

Another light modification takes advantage of the shape of the lamp's bulb and is accomplished by the obscuration plate 11. A portion of the lamp bulb as viewed from the test plane is obscured so as to reduce the light intensity at the center of the test plane. The obscuration plate is tailored such that the area of the bulb visible from the test plane as one moves along the Z-axis 33 remains constant. The obstruction is also tailored to vary the apparent lamp size in dependence upon the position on the test plane at which the lamp is viewed such that with a changing viewpoint from the center of the test plane to the edge along X-axis 34 the view of the bulb is gradually increased, thereby increasing the luminance at the location accordingly. To accomplish this function, the disk of the requisite geometry is mounted symmetrically in the light aperture or light window 5.

Figure 9:
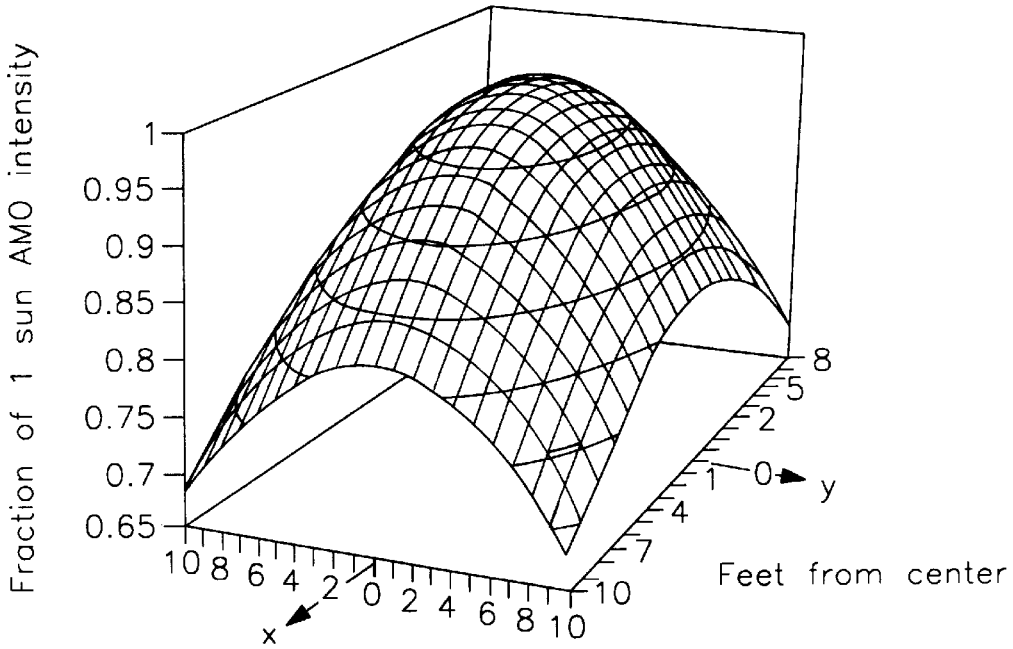
FIG. 9 graphically illustrates the light intensity distribution at the test plane obtained with the lamp in FIG. 1, and with the light modifier elements used in the embodiment omitted.
Figure 10:
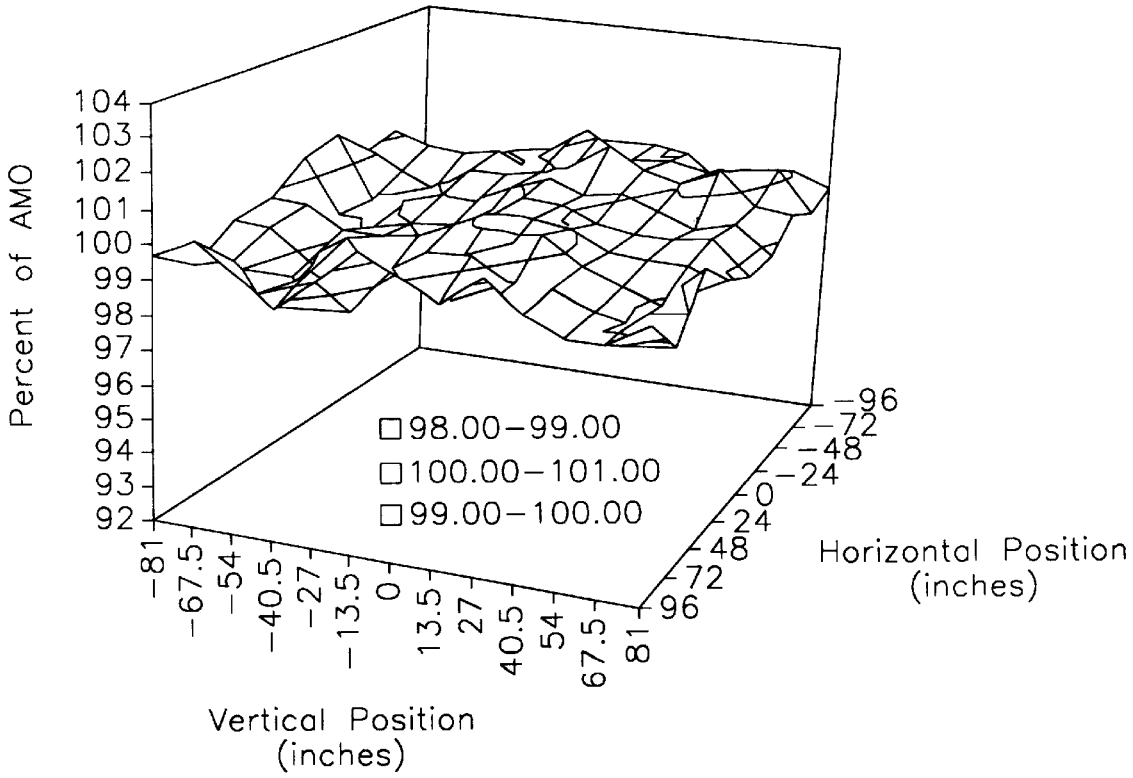
FIG. 10 graphically illustrates the light intensity distribution measured at the test plane obtained with the embodiment of FIG. 1.
Figure 11:
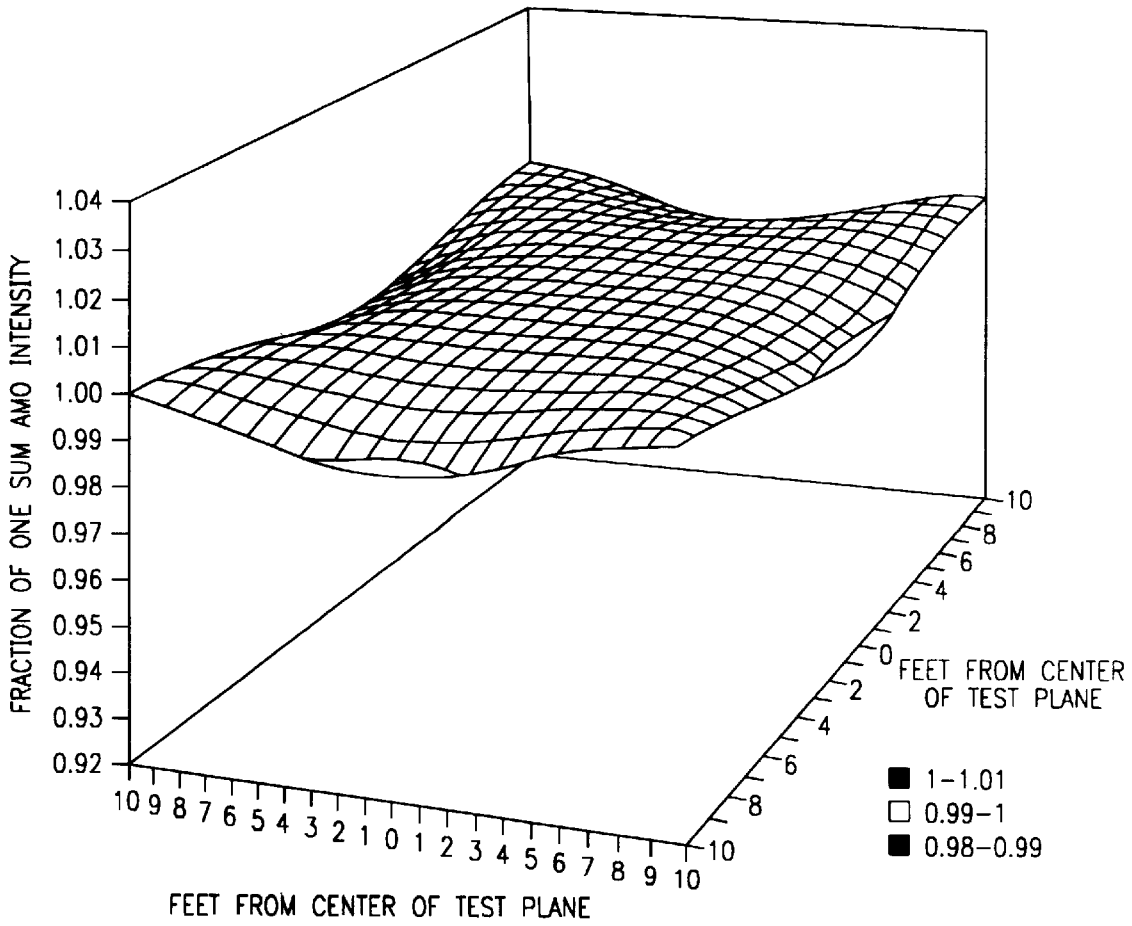
FIG. 11 graphically illustrates the light intensity distribution at the test plane obtained theoretically by calculation.

FIG. 9 is a three dimensional plot of the light intensity measured with a standard photo-voltaic cell obtained at various points on the test plane when the Xenon lamp 1 is operated with the mirrors and light obscuration plate 11 removed. As shown, the light intensity is uneven and varies significantly from a very high intensity at the center and dramatic fall of at the corners. FIG. 10 is a graphical depiction of the measurements obtained with the mirrors adjusted and in place and the obscuration plate installed. The light intensity is uniform, that is, the intensity varies over the test plane from the constant value of 1 AMO by no more than plus or minus two per cent, which, is regarded as constant. The values obtained in FIG. 10, are seen to correspond quite closely with a set of calculated theoretical intensity values that are depicted in FIG. 11.

The foregoing discussion of FIG. 7 and 8 should be recognized as a generalization. It ensures a general visualization of operation that is helpful to understanding the more detailed description that follows. With an understanding of the foregoing general operation and result, one may individually consider the function of obstruction plate 11 and mirrors 17, 19, 21 and 23 more fully.

Reference is again made to FIG. 2, which illustrates the obscuration plate 11 to a larger scale and in a more accurate geometry than in FIG. 1. Obscuration plate 11 blocks the view of a specific portion of the lamp to exactly counteract the intensity variation that otherwise would occur from the center of the test plane to the edge. Lamp 1 may be considered to be essentially uniform in light output along its length, although there is a slight increase in intensity at a longitudinal position mid-way along the lamps's glass tube or envelope. The obscuration disk geometry is designed so that greater and greater port ions of the lamp's surface become visible to view as one moves along the test plane from the center of the test plane to an outer edge, say, as example, along the X-axis in FIG. 1 or along the x axis in FIG. 7. Essentially, a greater portion of the side of the portion of the lamp's cylindrical envelope that was obscured at the center 29 is uncovered to view as the observation location is moved from the center along axis x in FIG. 7, either to the right or to the left.

Accordingly, the greater the portion of the lamp that may be viewed from a given location on the test plane, the greater is the light intensity received at that location directly from the lamp. The additional light provided thereby directly from the lamp to the test plane surface as one moves toward the test plane's outer edge counteracts the reduction in intensity of the incident direct light from the unobstructed portion of the lamp's surface, occurring due to the "square law" and "cosine law" losses familiar to those who study the subject of physics.

Figure 12A:
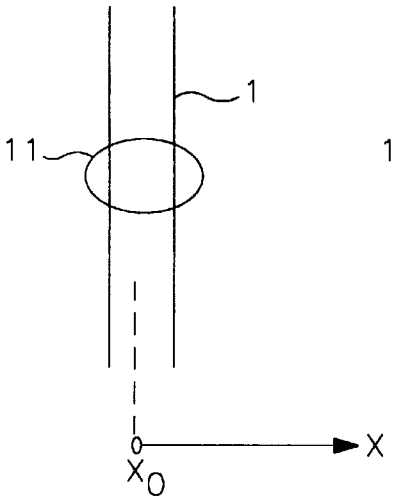
FIGS. 12*a*, 12*b*, and 12*c* are pictorial views of the obscuration plate and lamp as viewed from different positions helpful in the explanation of the operation of the invention.
Figure 12B:
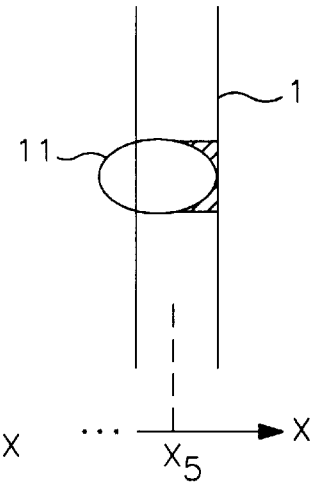
Figure 12C:
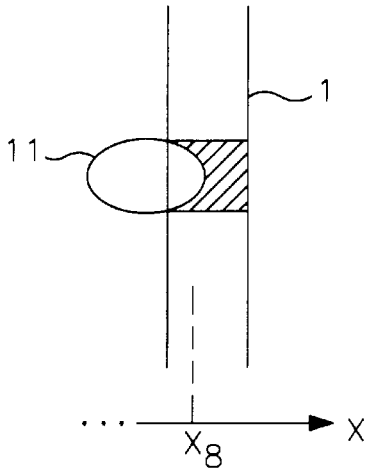

Reference is made to the pictorial illustrations of FIGS. 12A, 12B and 12C. At the center of the test plane a selected portion of the lamp tube 1 is blocked to view by obscuration plate 11 as represented in FIG. 12A. The height of the plate is such as to block a sufficient portion of the lamp tube, and, hence block sufficient light to limit the light intensity at the test plane center to the desired level. Sufficient direct light is provided to that location by the remaining portions of the cylindrical lamp tube.

As one moves along the x-axis away from the test plane center and to one side, because of the curved shape of obstruction plate 11, an additional portion of the cylindrical lamp tube 1 is exposed to view as illustrated in FIG. 12B, thereby allowing the lamp to directly supply more light to that second location. Moving further to the right along the X-axis to a third location, a still additional portion of the lamp surface is exposed to view from that third location as illustrated by FIG. 12C. By tailoring the shape of plate 11, that is the tapering of the plates height, it is possible to make up the deficit and permit the precise amount of additional light required at that location on the test plane to attain the desired level. Helpful criteria for achieving that initial tailoring follows.

An acceptable criteria for initially determining the shape of the obscuration or light blocking plate 11 is obtained through a mathematical analysis using the physical equations governing the properties of light, specifically the inverse square law and cosine law regarding light loss with distance and angle to the light source. First the test plane is divided into a convenient matrix or, more simply, a number of points or steps along the X-axis of the test plane. As example, a convenient number of steps selected is ten, which allows for easy division and has been found acceptable in practice. Thus for a twenty by twenty foot test plane, there is ten feet between the center and left edge of the test plane, and ten feet between the center and right edge of the test plane. When those numbers are divided by ten, the dividend gives convenient increments of one foot each.

With the mirrors and obscuration plate 11 removed from the housing, the xenon lamp 1 is operated and the generated light is directly incident on the test plane. The light intensity is then measured with a standard photo-voltaic cell at each of the ten steps along the X-axis to the left edge and at each of the ten one foot steps along the X-axis to the right edge and the data recorded. FIG. 9, earlier referenced, shows the measured intensity obtained over the entire test plane, including that measured along the x-axis. The data determines the level of light and shows the amount by which it exceeds or falls below the desired level, one AMO in the practical embodiment at each of the ten steps along the X-axis of the test plane.

Simple calculations using that data permits determination at each step location the reduction in intensity required to eliminate any excess light intensity to the desired level, or the increase in intensity required to erase any deficit in light intensity found and the increase required to raise the light intensity to the desired level. Thus, for example, if the light measured at one location is twenty two per cent lower in intensity than desired, one must uncover an additional twenty-two per cent of the lamp tube surface to view from that location. A tabulation of the calculated values defines the height of the obstruction plate at each of those ten steps from the center along the x-axis on the test plane.

It is recognized that the foregoing criteria does not account for the change in light intensity as necessarily occurs above and below the X-axis as additional portions of the cylindrical lamp surface come into view. In practice it is found that need not be taken into account. Considering the uniformity obtained in practice, any such effect appears to be subsumed with the effects occurring through use of the mirrors and their adjustment, elsewhere herein described.

The mirrors are again considered. The angular distension of the trapezoid mirror segments or slices, such as presented by way of example in the pictorial illustration of FIG. 6 to which reference is again made, is governed by the distances 35 and 36 at distance 37. By design each corresponding mirror segment in a pair of mirrors located adjacent an end of the lamp, when in view from a vertical position off of the x-axis, provides an image of a portion of the lamp, and the two images of those portions total in size, that is, area, to a constant value, irrespective of the distance from the center, in the direction of the x-axis, from which the corresponding mirror segments are simultaneously viewed. What is true for the mirror segments also holds true for the mirrors.

Figure 13A:
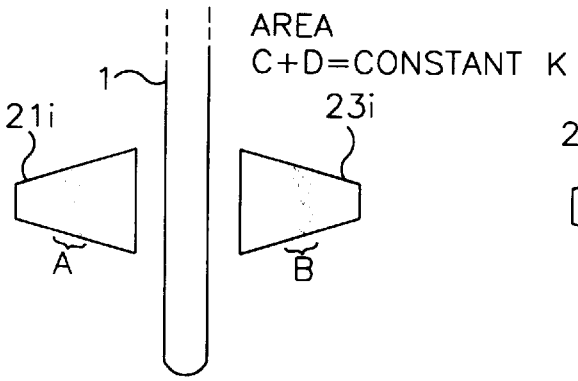
FIG. 13A is a pictorial view of the lamp and a pair of mirror segments as viewed from one position on the test plane and FIG. 13B is another pictorial view of the same elements as viewed from another position helpful to an explanation of operation.
Figure 13B:
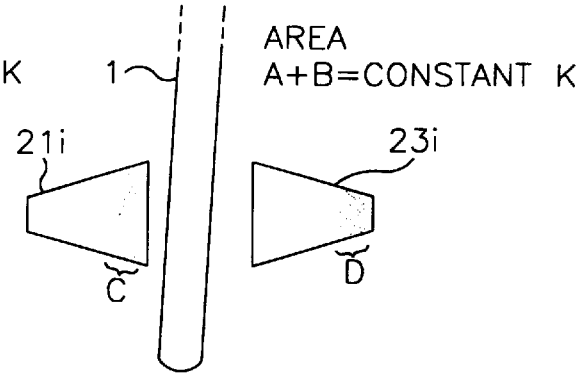

More specifically, referring to the pictorial view of FIG. 13A, viewed from a given vertical distance along the y-axis overlying the center of the test plane, each of the portions of lamp 1 reflected in the mirror segments 21*i* and 23*i*, represented by the shaded areas A and B, are equally spaced from the center and are of equal size. The sum of images A and B in total adds to a certain area or size, a constant, K. Viewed again in those same mirror segments, when positioned at the same vertical height above the x-axis as before, but moved to the left of center, almost to the left edge of the test plane, as pictorially illustrated in FIG. 13B, the images of the lamp portion C and D, appear in a different position that before and are of a slightly different size than the corresponding images A and B of FIG. 13A. However the sum of the areas of images, C and D adds up to the same total size or area, the constant, K.

As image A appears to change in position and move closer to lamp 1, as the observation point, as viewed from the rear of the test plane, moves to the left, due to the non-linearity in reflection, the image appears to get thinner, reducing the reflected light. However, as one moves closer to the lamp the height of the mirror segment increases, as does the image, increasing the reflected light. The effect of one counteracts or compensates for the other. In the corresponding mirror segment 23*i*, the image moves in the other direction and becomes wider and shorter. The trapezoidal shape of the mirror slice or segment offsets the non-linearity of the reflection of the lamp. Such non-linearities are induced by the swivel and pivot angles of the individual mirror assemblies and are equalized, regardless of the off-axis point of view.

Figure 6:
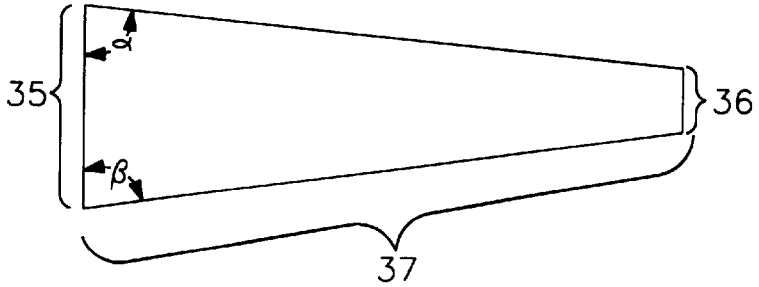
FIG. 6 is an enlarged view of a trapezoidal mirror segment used in the mirror of FIG. 2.

The top and bottom edges of each mirror segment in the upper pair of mirrors 17 and 19 is seen as a projection of the top edge of the light window 5 against the surface of the mirror, which is, as described, is oriented at an angle to the light window, with the trapezoidal segment's smaller edge 36 in FIG. 6 being closer to the light window 5 than the segment's wider edge 35. Likewise the top and bottom edges of each mirror segment in the bottom pair of mirrors is a projection of the bottom edge of the light window on the surface of the mirror, which is also at an angle to the plane of the light window. The effect is to define a trapezoidal shape or area for each mirror segment.

The number of mirror segments forming a mirror determines the graduation or steps in reflectivity one desires for operation of the apparatus. That, in turn, is determined by the number of points or steps one wishes to specify in the vertical direction, between the center and the respective top and bottom edges of the test plane. The greater the number of steps, the greater is the "resolution" obtainable. As example, a convenient number of steps selected is ten, a number which allows for easy arithemtic division in making calculations and has been found acceptable in practice. Thus, for a twenty by twenty foot test plane, there is ten feet between the center and top end of the test plane, and ten feet between the center and bottom edge of the test plane. Each of those distances when divided by ten, gives convenient increments of one foot each.

Figure 14A:
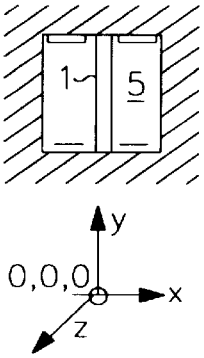
FIGS. 14A, 14B and 14C are pictorial illustrations of views of the mirrors observed from different positions used in connection with the explanation of operation.
Figure 14B:
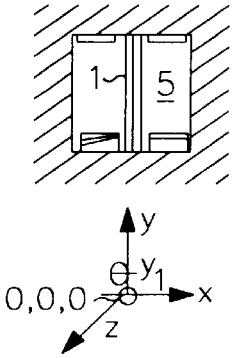
Figure 14C:
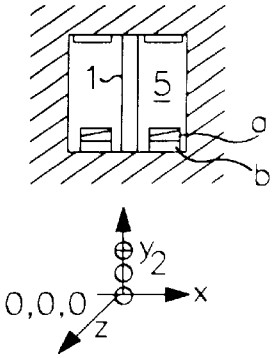

The height of each mirror segment is dependent upon the size of the test plane and the distance between the light window and the test plane. When viewed from the center of the test plane, none of the mirrors should be visible to the observer. Assuming a twenty foot square test plane, the test plane extends up ten feet and down ten feet from the center. Considering first the bottom pair of mirrors. Reference is made to the pictorial illustrations of the window 5 and lamp 1 in FIGS. 14A, 14B and 14C. As one moves from the center of the test plane where none of the mirror segments are in view, as in FIG. 14A, up one step along the y-axis, a distance of one foot, only the first mirror segment "a" of each mirror should be completely exposed to view, as represented in FIG. 14B. Moving vertically up another foot, the next mirror segment "b" of each of the two mirrors also comes into full view as in FIG. 14C. Continuing upward movement in one foot steps, when the tenth step is attained, corresponding to a position at the upper edge of and over the center of the test plane, all ten mirror segments of the bottom mirrors should be in full view. Neither of the mirrors in the top mirror pair can be viewed from the foregoing observation points.

The same action occurs in respect of the top pair of mirrors. As one moves from the center of the test plane down one step along the y-axis, a distance of one foot, only the first mirror segment of each mirror in the upper pair of mirrors should be completely exposed to view. Moving vertically down another foot, the next mirror segment of each of the two mirrors also comes into full view. Continuing downward movement in one foot steps, when the tenth step is attained, corresponding to a position at the lower edge of and under the center of the test plane, all ten mirror segments of the top mirrors should be in full view.

As one appreciates, the greater the size of the mirror surface and the number of segments exposed to view, the greater portion of the lamp viewed and, hence, the greater amount of light is reflected. The amount of light reflected by each mirror segment is also a direct function of the segment's reflectivity, which is described more fully elsewhere herein.

Ideally from any position along the x-axis through the center in FIG. 7, only portions of the surface of lamp 1 should be visible. The mirrors 17, 19, 21 and 23 should not be visible, although some edge of the mirror assembly, such as the mounting plate may be visible in practice. Thus only direct light from the lamp should be incident along axis x in the test plane. Further, the four mirrors should not be viewable from any position in the test plane; only the one or the other of the two mirror pairs should be viewable; either mirrors 19 and 23, the pair of mirrors adjacent the lower end of lamp 1, or 17 and 19, the pair of mirrors adjacent the upper end of lamp 1. Thus as one moves along the y axis vertically upward above the X-axis, looking at the light window, only the bottom pair of the mirrors, 19 and 23, or portions thereof, are visible. And as one moves along the y-axis vertically downward below the x-axis, looking at the light window only the top pair of the mirrors, 17 and 19, or portions thereof, are visible.

To initially establish the reflectivity characteristic values desired for each of segments in the mirror, such as the ten segments used in the preferred embodiment, one essentially repeats the procedure taken in establishing the obstruction plate's shape. However, this time light intensity measurements are taken along the Y-axis.

Thus, with the mirrors and obscuration plate 11 removed from the housing, the xenon lamp 1 is operated and the generated light is directly incident on the test plane. The light intensity is then measured with a standard photovoltaic cell at each of the ten steps along the Y-axis to the top edge and at each of the ten one foot steps along the Y-axis to the bottom edge of the test plane and the data recorded. Since the light projection is symmetrical, it is possible to calculate the necessary data for only one pair of mirrors, and assume the same levels would occur for the other pair of mirrors. FIG. 9, earlier referenced, shows the measured intensity obtained over the entire test plane, including that measured along the Y-axis.

The data determines the light level at each of the steps and shows the amount by which the light level falls below the desired intensity level, one AMO in the practical embodiment at each of the ten steps from the center along the Y-axis of the test plane.

Using that data, simple calculations permit determination at each step location the increase in intensity required to erase any deficit in light intensity found or, as alternatively stated, the increase required to raise the light intensity to the desired level. Given the required amount of light, and knowing the distance to that location on the test plane, and intensity of the lamp, and the height of the mirror segments, using known equations one calculates the amount of additional light needed. One then determines the reflectivity required of the first mirror segment necessary to attain that added light at the first step of the test plane, using the known equation of incident light multiplied by the reflectivity equals the reflected light. Usually at the first step, not much added light is required. Hence the reflectivity of the first mirror segment is very low, essentially that of plain glass.

One then proceeds to calculate the light required at the second step. Knowing the additional light required, and knowing the amount of light provided to the second step location by the first mirror segment, and image size of the first segment, subtracting provides the additional amount of light required of the second segment. From that one determines the reflectivity required by the second segment, which is usually a little greater than that determined for the immediately preceding mirror segment. This procedure of calculations is performed for each of the ten segments of the one of the mirror pairs. With the reflectivity specified for each mirror segment, one can then provide the appropriate surfaces for segments in each of the upper and lower mirror pairs.

As example, the required reflectance from each mirror element in FIG. 3 may be calculated from the required intensity. At the center position, the image size of the lamp is $S_L$ and the absolute intensity per unit area of the lamp is I, such that the intensity from the lamp, $I_L$, is $I^*S_L$. Using FIG. 7, at the first position off axis from center, position 34, the image size $S_L$ of the lamp decreases according to the square law while the intensity per unit area, I, of the visible lamp is reduced by the cosine of the angle, $\theta_a$, from that position to the center line. The image size of the reflectance in the mirror elements, 3*a,* is $S_a$ and the effective intensity of the reflection is $I_a$. $I_a$ is equal to the the intensity I multiplied by the reflectance, $R_a$, of the mirror element, a, and the cos of $\theta_a$, that is $I_a=I^* \cos(\theta_a)^* S_a{}^* R_a$. The total intensity of the light at the first position off center axis is the sum of the intensities, $I^* \cos(\theta_a)^* S_L + I^* \cos(\theta_a)^* S_a{}^* R_a$. For simplification, the angle to the mirrors and the angle to the lamp have been set to the same angle $\theta_a$ and this results in negligible error. The total intensity may be set to an intensity function, $I_p$, such that solving for the reflectance required from visible the mirror elements, 3*a,* is $$R_a=(I_p-I^* \cos(\theta_a)^* S_L)/(I^* \cos(\theta_a)^* S_a).$$

Similarly, the image size of the reflections in the mirror elements, 3*b,* visible at the second position off axis, 35, is $S_b$, the intensity is reduced by the cos of $\theta_b$, and the intensity of the reflection is $I_b$. As above, the intensity, $I_b$, is equal to the absolute intensity, I, times the reflectance, $R_b$, of the mirror elements, 3*b*, and the cos of $\theta_b$, that is $I_b=I^* \cos(\theta_b)^* R_b$. The total intensity at the second position off axis is the sum of the intensities $I_L$, $I_a$, and $I_b$, that is, $I_p=I^* \cos(\theta_b)^* S_L + I^* \cos(\theta_b)^* R_a{}^* S_a + I^* \cos(\theta_b)^* R_b{}^* S_b$. Again setting the intensity to $I_p$ and solving for the reflectance required of the mirror elements, 3*b*, is $$R_b=(I_p-I^* \cos(\theta_b)^* S_L-I^* \cos(\theta_b)^* R_a{}^* S_a)/(I^* \cos(\theta_b)^* S_b).$$

This method is extended to the remaining mirror elements 3*c* through 3*j*.

For this embodiment, the desired intensity function, $I_p$, as enumerated in the chart below, is slightly and continuously decreased along each of the axes x and y in the test plane starting at 1 sun AMO in the center position and reduced at the edge position. This same function, $I_p$, is used for the determination of the view of the lamp required around the obscuration disc 11. Using this function, the combined intensities from the mirror elements 3*a* through 3*j* and from the lamp visible around the obscuration disc 11 results in an intensity of 1 AMO along the diagonal in the test plane from the corner position to the center position as shown in FIG. 11. The function $I_p$ may be found by trial and error or by performing a calculation on a spreadsheet grid.

| Position from center (feet) | 0 | 1 | 2 | 3 | 4 | 5 | 6 | 7 | 8 | 9 | 10 |
|---|---|---|---|---|---|---|---|---|---|---|---|
| $I_p$ | 1 | 1 | 1 | .9999 | .9996 | .9991 | .9982 | .9968 | .9947 | .9919 | .9882 |

Following assembly of the foregoing elements, the mirrors are set to an initial orientation, the obscuration plate installed and the power applied to the lamp. The angle of tilt or tilt of each mirror 17, 19, 20 and 21 from the horizontal plane X-Z is selected so that at any position on the test plane 31 it is not possible to view the lamp electrodes 1*a* and 1*b* found at the end of the cylindrical lamp tube 1. One should be able to view only the lamp tube portion of lamp 1 in the respective mirrors.

When one is located at any position on the test plane above or below the X-axis, where the mirrors or segments of the respective pair of mirrors are intended to be in view, as earlier described, no portion of the reflected image of the Xenon lamp in any mirror should become obscured or blocked by any portion of the cylindrical lamp tube, as one moves horizontally along the vertical position, above or below the X-axis, any where to the left and/or to the right, all the way to either the left edge and/or right edge of the test plane. Were such obstruction to occur, it could block a portion of the light reflected from the mirror to the surface, which is not desired. To meet that criteria, each mirror must be sufficiently rotated in position relative to the plane of light window 5 before the respective mirror is fixed in position, ensuring that an image of the lamp can be viewed in the mirror, even at the right and left hand edges of the test plane when observed from either above or below the x-axis.

By operating the apparatus and moving a solar cell along the test plane, various light intensity readings are attained. The readings are evaluated and an appropriate adjustment of the mirror can be made and the test repeated. The initial mirror and obscuration mountings are adjusted interactively solar cell to achieve minimum intensity variability over the test plane area. Thus the outer portions of the obscuration plate may be removed or added to, if more or less light is found to be needed in the central area. Through trial and error, the proper adjustment or calibration is eventually located as provides an essentially constant light intensity over the test plane. Once so calibrated, the solar array to be tested is placed at the test plane and its testing is easily accomplished.

Although the invention has been described in connection with the testing of a solar array that is twenty-foot square, the application of the invention is not so limited. As one appreciates since the structure is capable of throwing a uniform field of light over a twenty foot by twenty foot area, it also throws a uniform field over lesser areas. The invention therefore may also be used to test solar arrays of smaller areas as well.

Where the test environment contains reflections and glint, large baffles may be placed between the simulator and the solar array to minimize the effect of those reflections and glint from off the walls, floor and/or ceiling of the environment. A large tent-like assembly covered with a black cloth on all exterior surfaces and the interior floor, and within that assembly, a series of baffles of increasing size located between the solar simulator and the solar array, should be satisfactory.

Although the foregoing structure has been described in connection with providing uniform coverage over an area twenty foot by twenty foot in size, and test plane distances of about twenty six feet, those skilled in the art appreciate that the foregoing structure could be adapted to coverage of larger areas, 30 foot square, forty foot square and greater, and at greater test plane distances using a higher power lamp and the design techniques described herein. Moreover, although the principal purpose is testing of a solar array having a relatively planar surface, the structure can be modified to provide a uniform intensity filed on surfaces of other geometry, such as a cylindrical surface for testing of cylindrical shaped solar panels, using the light sculpting techniques described.

The obscuration plate used in the foregoing embodiment is totally light blocking. However in other applications the invention can be practiced by using other types of plates that attenuate but do not completely block the light.

The invention may be practiced with lamps other than those of an elongate cylindrical shape. However, as is appreciated from the foregoing description, the sculpting of the light in accordance with the foregoing description is recognized as significantly more complex to implement in a practical device. For that reason the simple cylindrical geometry is preferred.

Upon reading this specification, those skilled in the art recognize that the invention is not limited to solar simulators and may also be implemented with lamps of lower power should the need in a specific application require less light than that needed to emulate the sun's intensity at a distance of twenty-six feet. A lower power requirement also reduces the physical size of the power supply from that required for the application earlier described and make the unit more portable and convenient to transport. As example of one application where lesser light is required would be in specialized photographic applications in which a uniform light over a wide area may be needed, such as when photographing a large group.

It should be appreciated that the terms right and left, vertical and horizontal, and the like, which are used in the description of the embodiment illustrated in FIG. 1 and the other figures is relative. The embodiment of FIG. 1 may be turned on its side, wherein those vertically oriented elements are then positioned horizontally. The embodiment functions in the same manner with the same elements to produce the same results, irrespective of its angular orientation. And as those skilled in the art appreciate from the foregoing description, the four mirrors in the foregoing embodiment are not required to and do not focus light. Hence, those mirrors may be referred to generically as non-focusing mirrors.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. Electrical apparatus for casting a uniform light field over a predetermined surface, comprising:

an electrical light generator, said electrical light generator including a light emitting surface of predetermined geometry for emitting light, with a portion of said emitted light passing directly to said predetermined surface;

said light emitting surface including first and second end regions and a center region located therebetween;

a light obstructing barrier for preventing a center portion of said predetermined surface from receiving light directly from only said center region of said light emitting surface; and light modifier means for modifying another portion of light emitted from said light emitting surface and directing said modified light to said predetermined surface to produce at each location on said predetermined surface a combination of direct light from said light emitting surface and modified light essentially equal in intensity to a constant intensity value;

said light modifier means including:

non-focusing mirror means for reflecting light incident from said light emitting surface to said predetermined surface, said mirror means having a positionally graduated reflectivity.

2. The electrical apparatus as defined in claim 1, wherein said electrical light generator comprises a single high intensity gas discharge device.

3. The electrical apparatus as defined in claim 2, wherein said single high intensity gas discharge device comprises a Xenon lamp, said Xenon lamp comprising a light emitting surface having a cylindrical geometry.

4. The electrical apparatus as defined in claim 1, wherein said light obstructing barrier comprises:

a plate, said plate having convexly curved upper and lower ends, said plate being sufficient in size to overlie only said center region of said light emitting surface as viewed from said center portion of said predetermined surface; and said plate being centrally positioned in front of said light emitting surface to block light emitted from said center region of said light emitting surface from direct incidence upon at least the center of said predetermined surface, while permitting direct incidence of light emitted from said center region of said light emitting surface upon other positions of said predetermined surface that are displaced from said center of said predetermined surface.

5. The electrical apparatus as defined in claim 1, wherein said electrical light generator further comprises a housing, said housing having non-light reflective interior walls and a light window exposed to said predetermined surface;

said light window having a center located on a common axis with the center of said predetermined surface;

wherein said light emitting surface is positioned in said housing with the axis of said light emitting surface oriented to bisect said light window;

wherein said mirror means is located within said housing, said mirror means being positioned adjacent said light emitting surface for receiving and reflecting light from said light emitting surface incident thereupon;

wherein said light obstructing barrier is located within said light window positioned at the center of said light window symmetric with the sides of said light window; and wherein said light obstructing barrier comprises a front side facing away from said light emitting surface and a back side facing said light emitting surface, and said back side of said light obstructing barrier comprising a non-reflective surface.

6. The electrical apparatus as defined in claim 1, wherein said mirror means includes: at least one mirror, said mirror having a plurality of trapezoidal shaped mirror segments, arranged next to one another in serial order with the longer axis of each segment being essentially in parallel with one another, said mirror segments increasing in reflectivity from a first one of said segments to a last one of said segments in said serial order.

7. The electrical apparatus as defined in claim 1, wherein said light obstructing barrier comprises:

a plate, said plate having a curved geometry, said plate being sufficient in size to cover a portion of said light emitting surface from direct view from the center of said predetermined suface; and said plate being positioned in front of said light emitting surface to block light emitted from said covered portion of said light emitting surface from direct incidence upon at least the center of said predetermined surface, while permitting direct incidence of light from said covered portion on other portions of said predetermined surface that are laterally spaced from said center thereof; and wherein said electrical light generating means further comprises:

a housing, said housing having non-light reflective interior walls and a light window exposed to said predetermined surface;

said light window having a center located on a common axis with the center of said predetermined surface;

wherein said light emitting surface is positioned in said housing with the axis of said light emitting surface oriented to bisect said light window;

wherein said mirror means is located within said housing, said mirror means being positioned adjacent said light emitting surface for receiving and reflecting light from said light emitting surface incident thereupon; and wherein said light obstructing barrier is located within said light window positioned at the center of said light window symmetric with the sides of said light window; and wherein said mirror means includes: at least one mirror, said mirror having a plurality of trapezoidal shaped mirror segments, arranged next to one another in serial order with the longer axis of each segment being essentially in parallel with one another, said mirror segments increasing in reflectivity from a first one of said segments to a last one of said segments in said serial order.

8. The electrical apparatus as defined in claim 7, wherein said electrical light generator comprises a single Xenon lamp.

9. A solar simulator for producing a uniform field of light on a distant test plane, comprising:

a housing containing a light window and non-light reflective internal walls;

light reflecting means located in said housing for reflecting light incident thereon through said light window to at least the corners of said test plane;

an electrically powered high intensity gas discharge lamp located in said housing behind said light window and positioned symmetrically relative to said window and adjacent said light reflecting means for producing light; wherein a portion of said light passes through said light window to directly expose said test plane to direct light from said gas discharge lamp and wherein another portion of said light is incident on said light reflecting means;

said light reflecting means being positionally graduated in reflectivity along one direction, whereby light of a given intensity incident on said light reflecting means is reflected with a lesser intensity that varies in level in dependence upon the position along said one direction on said light reflecting means from whence such incident light is reflected wherein the sum of said reflected light from said light reflecting means and any of said direct light from said gas discharge lamp incident at each position within said test plane is of a substantially constant intensity.

10. The invention as defined in claim 9, wherein said high intensity gas discharge lamp includes an elongate envelope and wherein light is produced throughout said elongate envelope, said light being generally uniform in intensity along said envelope and being of higher intensity at a mid location along said elongate envelope; and, further comprising:

light obscuring means; said light obscuring means being located in said light window for blocking light emitted from a central portion of said lamp from direct incidence on the center of said test plane, while permitting light emitted from said central portion of said lamp to be directly incident on other portions of said test plane that are spaced from said center.

11. The invention as defined in claim 10 wherein said high intensity gas discharge lamp comprises an Xenon lamp, said Xenon lamp comprising an elongate cylindrical envelope.

12. The invention as defined in claim 9 wherein said light reflecting means comprises a plurality of mirrors, each of said mirrors having a mirror surface of spatially graduated reflectivity.

13. A solar simulator for producing a uniform field of light on a distant test plane, comprising:

a housing containing a light window and non-light reflective internal walls;

light reflecting means located in said housing for reflecting light incident thereon through said light window to at least the corners of said test plane;

an electrically powered high intensity gas discharge lamp located in said housing behind said light window and positioned symmetrically relative to said window and adjacent said light reflecting means for producing light; wherein a portion of said light passes through said light window to directly expose said test plane to direct light from said gas discharge lamp and wherein another portion of said light is incident on said light reflecting means;

said light reflecting means being positionally graduated in reflectivity along one direction, whereby light of a given intensity incident on said light reflecting means is reflected with a lesser intensity that varies in level in dependence upon the position along said one direction on said light reflecting means from whence such incident light is refected;

wherein said light reflecting means comprises at least one mirror having a mirror surface of spatially graduated reflectivity and wherein said mirror surface of spatially graduated reflectivity comprises:

a plurality of exposed mirror surface strips, said strips being arranged side by side in serial order, each said strip in said serial order being of a reflectivity that is greater in level than the next higher strip in said serial order.

14. The invention as defined in claim 12 wherein said plurality of mirrors comprises four separate mirrors.

15. The invention as defined in claim 14, wherein a first and second one of said four separate mirrors are positioned on the opposite sides of and at the upper end of said high intensity gas discharge lamp; and wherein a third and fourth one of said four separate mirrors are positioned on the opposite sides of and at the lower end of said high intensity gas discharge lamp.

16. The invention as defined in claim 12, wherein said mirror surface of spatially graduated reflectivity comprises:

a plurality of exposed mirror surface strips, said strips being arranged side by side in serial order, each said strip in said serial order being of a reflectivity that is greater in level than the reflectivity of the next higher strip in said serial order.

17. The invention as defined in claim 12, wherein said gas discharge lamp includes an elongate envelope and wherein light is produced throughout said elongate envelope, said light being generally uniform in intensity along said envelope and being of higher intensity at a mid location along said elongate envelope; and, further comprising:

light intensity reducing means; said light intensity reducing means being located in said light window for limiting said higher intensity light at said mid location of said envelope from direct passage to the center of said test plane.

18. The invention as defined in claim 14, further comprising:

mirror support means for supporting each of said four mirrors; said mirror support means being adjustable to selectively permit adjustment of mirror tilt and angular position relative to said high intensity gas discharge lamp.

19. The invention as defined in claim 18, wherein said high intensity gas discharge lamp comprises an Xenon lamp.

20. A solar simulator for providing a field of light of substantially uniform intensity over the area of a large area test plane, comprising:

a housing, said housing containing a plurality of internal walls including a front wall, and each of said internal walls being non-light reflective in characteristic;

said front wall including a light window for permitting passage of light out of said housing;

said light window comprising a square shaped opening and said square shaped opening having by upper and lower straight edges and right and left side straight edges bordering said opening and defining a first plane;

an Xenon lamp for generating light, said Xenon lamp comprising an elongate cylindrical envelope, said envelope having a cylindrical axis and first and second ends spaced along said cylindrical axis, said lamp generating light along the length of said cylindrical axis and generating light of increased intensity at a central area of said envelope mid-way between said first and second ends;

said Xenon lamp being positioned in said housing behind said light window a predetermined distance with said elongate cylindrical envelope being positioned in parallel to said first plane and in parallel with said right and left side straight edges of said window and mid-way there between and perpendicular to said upper and lower straight edges to symmetrically position said lamp in said light window;

a plurality of non-focusing mirrors located within said housing for reflecting incident light from within said housing out said light window, said plurality of mirrors comprising first, second, third and fourth mirrors; each of said mirrors being substantially identical and having a positionally graduated reflectivity;

said first mirror being positioned within said housing to the right side of said lamp and above said upper edge of said opening and being tilted relative to said plane and said cylindrical axis of said envelope for reflecting light through said light window at an angle to said plane downwardly and to the left, whereby said first mirror directs light toward a lower left edge of said test plane;

said second mirror being positioned within said housing to the left side of said lamp and above said upper edge of said opening and being tilted relative to said plane and said cylindrical axis of said envelope for reflecting light through said light window at an angle to said plane downwardly and to the right, whereby said second mirror directs light toward a lower right edge of said test plane;

said third mirror being positioned within said housing to the right side of said lamp and below said lower edge of said opening and being tilted relative to said plane and said cylindrical axis of said envelope for reflecting light through said light window at an angle to said plane upwardly and to the left, whereby said first mirror directs light toward a upper left edge of said test plane;

said fourth mirror being positioned within said housing to the left side of said lamp and below said lower edge of said opening and being tilted relative to said plane and said cylindrical axis of said envelope for reflecting light through said light window at an angle to said plane upwardly and to the right, whereby said second mirror directs light toward an upper right edge of said test plane;

each of said mirrors having first and second ends and further comprising a reflectivity graduated in level between said first and second ends with said reflectivity being lowest in level at said first end and increasing to the highest level of reflectivity at said second end, whereby light of a given intensity incident on said mirror is reflected with a lesser light intensity that varies in intensity level in dependence upon the position between said first and second ends from whence such incident light is refected, ranging between a lowest level at said first end and a highest level at said second end; and a light obstructing barrier for blocking light emitted from said central area of said Xenon lamp's envelope from passing out said light window in a direction orthogonal to said plane along said central axis, while permitting light emitted from said central area of said Xenon lamp's envelope to pass out said light window in a non-orthogonal angle to said plane, said light obstructing barrier being positioned in the center of said opening and obstructing a small portion of said opening.

21. The invention as defined in claim 20, wherein each of said mirrors comprise:

a first straight flat mirror surface mounted to a flat support, said first mirror surface having a reflectivity of R1;

a second straight flat mirror surface mounted to said first mirror surface and partially overlapping said first mirror surface to leave exposed a slice of said first mirror surface, said second mirror surface having a reflectivity of R2;

a third straight flat mirror surface mounted to said second mirror surface and partially overlapping said second mirror surface to leave exposed a slice of said second mirror surface, said third mirror surface having a reflectivity of R3;

a fourth straight flat mirror surface mounted to said third mirror surface and partially overlapping said third mirror surface to leave exposed a slice of said third mirror surface, said fourth mirror surface having a reflectivity of R4;

a fifth straight flat mirror surface mounted to said fourth mirror surface and partially overlapping said fourth mirror surface to leave exposed a slice of said fourth mirror surface, said fifth mirror surface having a reflectivity of R5;

a sixth straight flat mirror surface mounted to said fifth mirror surface and partially overlapping said fifth mirror surface to leave exposed a slice of said fifth mirror surface, said sixth mirror surface having a reflectivity R6;

a seventh straight flat mirror surface mounted to said sixth mirror surface and partially overlapping said sixth mirror surface to leave exposed a slice of said sixth mirror surface, said seventh mirror surface having a reflectivity of R7;

an eighth straight flat mirror surface mounted to said seventh mirror surface and partially overlapping said fifth mirror surface to leave exposed a slice of said fifth mirror surface, said eighth mirror surface having a reflectivity R8; and where $R1<R2\leqq R3<R4<R5<R6<R7<R8$ to provide slices of mirror surfaces splayed side by side for providing a mirror of spatially graduated reflectivity.

22. The invention as defined in claim 21, wherein each of said mirror surfaces comprises a trapezoidal shape.

23. Apparatus for applying a field of light of uniform intensity, I, over a surface of predetermined area, comprising:

a light aperture visible to said surface;

an electrically powered light source for generating light, said light source having an elongate geometry, including central and outer portions;

said light source being located to one side of and symmetrically positioned with respect to said light aperture for permitting light to propagate through said light aperture and incident directly upon said surface;

a light blocker for preventing light emitted from said central portion from propagating orthogonal to and through said light aperture directly to said surface, wherein light generated from said outer portions, propagates through said aperture directly to said surface;

said light blocker including a barrier, said barrier being positionally tapered in geometry in dependence upon distance from a center of said aperture for permitting predetermined amounts of light from said central portion to propagate through said aperture in a direction non-orthogonal to said light aperture for incidence upon said surface;

light reflecting means located adjacent said light source to said one side of said light aperture for reflecting light from said light source through said aperture to said surface, said light reflecting means having a surface that is graduated in reflectivity, said reflectivity progressively increasing from a minimum at one end of said light reflecting means to a maximum at an opposed end;

wherein light provided at any given location on said surface directly from said light source is additive with any reflected light provided by said light reflecting means to said given location to produce an intensity of light incident at said given location on said surface that is essentially equal to I.

24. A solar simulator for testing very large solar arrays, comprising:

means for uniformly illuminating at least a 20 foot square surface with a light pulse having an intensity of one AMO solar intensity from a distance of between twenty-three to twenty eight feet, said means including a single electrically powered high intensity discharge lamp for generating a light pulse: and a power supply for supplying electrical power to said means.

* * * * *